US007020923B1

(12) United States Patent
Jangula

(10) Patent No.: US 7,020,923 B1
(45) Date of Patent: Apr. 4, 2006

(54) FASTENER REMOVAL TOOL

(75) Inventor: James Jangula, Bismarck, ND (US)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 11/191,818

(22) Filed: Jul. 28, 2005

Related U.S. Application Data

(60) Provisional application No. 60/635,125, filed on Dec. 10, 2004.

(51) Int. Cl.
*B66B 15/00* (2006.01)
*B25B 23/16* (2006.01)

(52) U.S. Cl. ..... 7/166; 7/158; 7/168; 81/177.4

(58) Field of Classification Search ..... 7/166, 7/158, 168, 118, 128, 167; 81/177.4, 439, 81/29; D8/29
See application file for complete search history.

(56) References Cited

U.S. PATENT DOCUMENTS

| | | | | |
|---|---|---|---|---|
| 3,680,834 | A * | 8/1972 | Holloway | 254/25 |
| 5,077,879 | A * | 1/1992 | Haviv | 29/268 |
| 5,450,774 | A * | 9/1995 | Chang | 81/440 |
| 5,459,897 | A * | 10/1995 | Wurdack | 7/166 |
| 5,791,211 | A * | 8/1998 | Bondhus et al. | 81/440 |
| 6,286,168 | B1 * | 9/2001 | Woodruff et al. | 7/138 |
| 6,564,878 | B1 * | 5/2003 | Williams et al. | 172/49.5 |
| 6,601,481 | B1 * | 8/2003 | Chuang | 81/440 |

* cited by examiner

*Primary Examiner*—Lee D. Wilson
*Assistant Examiner*—Alvin J. Grant
(74) *Attorney, Agent, or Firm*—Banneer & Witcoff, Ltd.

(57) ABSTRACT

A body shop tool includes at least four fold out tool elements pivotally mounted at one end of a trough shaped holder and a fastener pry tool pivotally mounted at the opposite end of the through shaped holder wherein the pry tool is configured to fit over, retain and protect the at least four tool elements when the tool elements and pry tool are in the folded or storage position.

4 Claims, 2 Drawing Sheets

80
78
76
74
70
72
60
62
64
66
40
42
46
48
50
52
54
56
90
30
16
22
18
10
14
28
26
24
20

FASTENER REMOVAL TOOL

CROSS REFERENCE TO RELATED APPLICATION

This application is a utility application based upon previously filed provisional application Ser. No. 60/635,125 filed Dec. 10, 2004 for "Fastener Removal Tool" which is incorporated herewith by reference.

BACKGROUND OF THE INVENTION

In a principal aspect, the present invention relates to a fastener removal tool of the type which includes multiple tool elements maintained in a trough shaped carrier. The separate tool elements are foldable between a storage position within the trough shaped carrier and a work position in which separate elements are folded outwardly about pivot pins used to mount the tool elements within the trough shaped carrier.

Various tools, such as knife blades, Allen wrenches and the like are often incorporated in a single composite tool incorporating a storage element or bracket with the individual tool elements pivotally mounted therein and foldable between a position within the bracket and a position projecting from the bracket for use. Such tools have been made available for example as a device which includes multiple sized Allen wrenches and other types of wrench devices wherein three, four or more tool elements are incorporated at each end of an elongate bracket member. Such tools have been principally limited to embodiments involving cutting tools such as knife blades and fastener tools such as Allen wrenches and screwdrivers. Such tools have not been highly useful or available for use in body shops. The present invention provides a tool useful particularly in a body shop environment.

SUMMARY OF THE INVENTION

Briefly, the present invention comprises a multiple element, repair and fastener removal tool especially useful in a body shop. The tool includes a body member in the form of an elongate trough with a plurality of at least four tool elements supported on a pivot member at one end of the trough and a single, bifurcated pry tool element pivotally mounted at the opposite end of the trough. The tool is constructed so that the bifurcated pry tool element is formed from a generally planar sheet of metal stock and is configured so that it can fold over, retain and protect the multiple tool elements arrayed at the opposite end of the tool when all of the elements are in a tool storage position.

Thus, it is an object of the invention to provide an improved multiple working element tool, particularly useful in body shops and by body shop workers.

It is a further object of the invention to provide a multiple tool element fastener removing tool.

Another object of the invention is to provide a multiple component tool having multiple tool elements which is easy to use, economical, safe to use, compact to provide for storage of the tool elements, and which enables use of any one of multiple tool elements incorporated in the tool.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
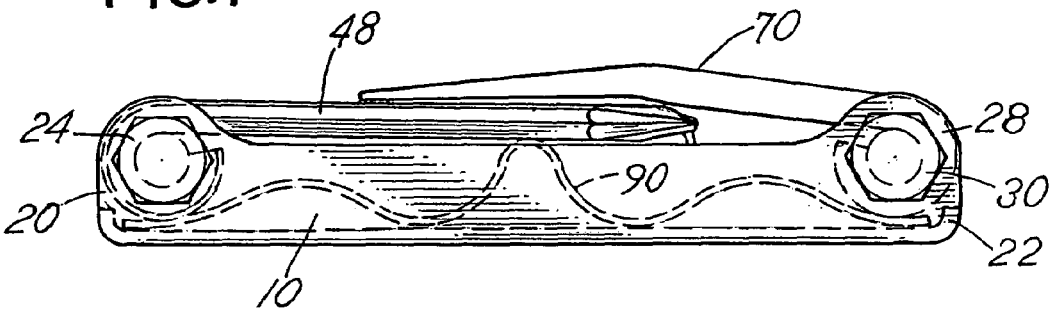
FIG. 1 is a side view of the tool of the invention.
Figure 3:
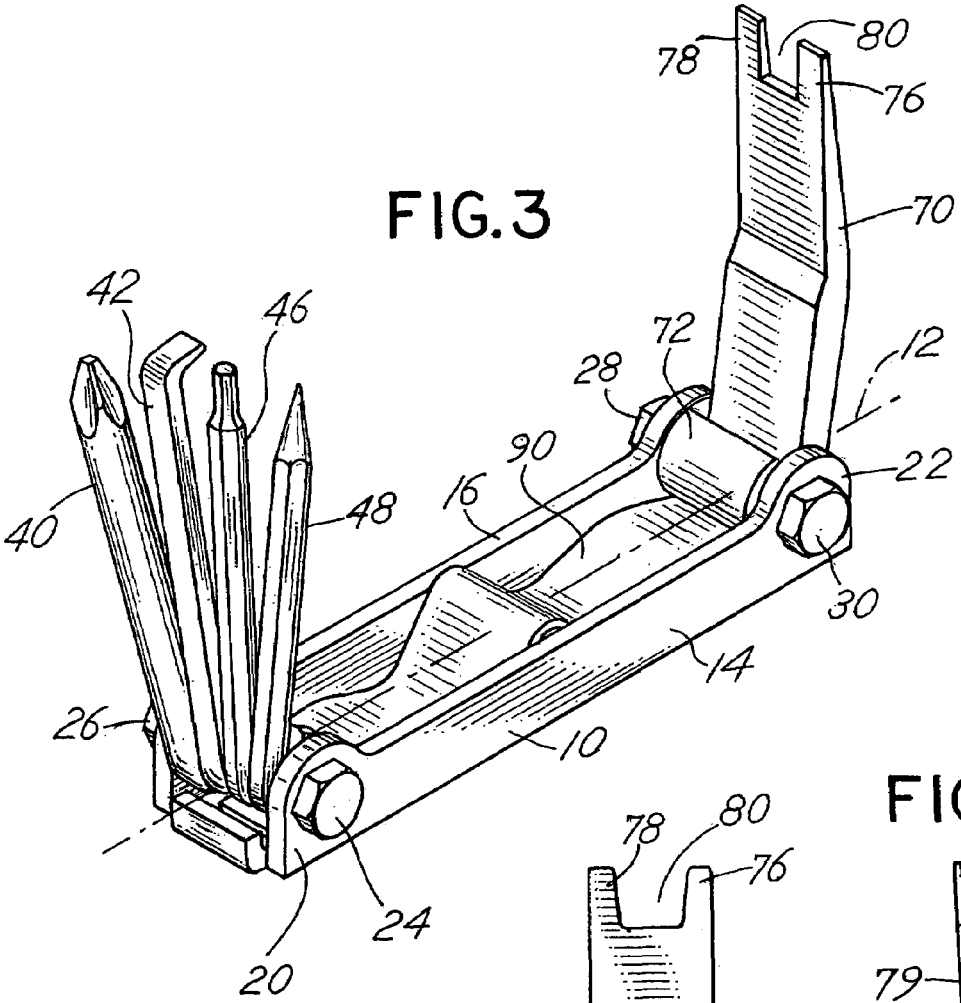
FIG. 3 is an isometric view of the tool of FIG. 1 wherein the various working tool elements of the tool are pivoted to a partially or fully opened position.

The fastener removal tool of the invention is especially useful for the removal of automotive type fasteners including, for example, metal screws, plastic push pins and other types of automotive fasteners. Additionally, the tool is especially useful for tasks performed by body shop mechanics inasmuch as the individual tools incorporated in the preferred embodiment of the tool are especially utilitarian for tasks with respect to body repair of an automobile.

Thus, referring to the figures, the tool of the invention includes a body member 10 in the form of an elongate formed trough having a longitudinal axis 12. The body member 10 thus includes a first side wall 14 and a second generally parallel, spaced side wall 16. The side walls 14, 16 are formed and connected by a web 18 and terminate at a first upturned end or end wall 20 and a second upturned end or end wall 22. The ends 20 and 22 are generally mirror images of one another. The spaced side walls 14 and 16 adjacent the ends 20, 22 provide a platform through which fasteners; namely, a bolt 24 and a nut 26, as well as a bolt 28 cooperative with a nut 30 may be attached respectively. The bolts 24 and 28 serve as pivot pins or pivot members for the tool elements described below.

Positioned adjacent the first end 20 between the sides or side walls 14 and 16 is a series of four tool elements 40, 42, 46 and 48. Each of these tool elements 40, 42, 46, 48 is formed from a single elongate, generally straight, bar stock and includes a formed loop at one end, for example, the loop 50 associated with tool element 40. The formed loop 50 receives the shaft of the bolt 24 so that the tool element 40 can be held between the side walls 14 and 16. Similarly, the tool elements 42, 46 and 48 include end loops 52, 54 and 56 cooperative with the bolt 24 at the first end 20 to pivotally mount the tool elements 40, 42, 46 and 48 for rotation about the longitudinal axis of bolt 24. Washers (not shown) may be positioned between adjacent tool elements.

Each of the tool elements 40, 42, 46 and 48 is a generally elongate member sized so that it can pivot and fit or nest into the trough defined between the side walls 14 and 16 of the body member 10. Each of the tool elements 40, 42, 46 and 48 includes a unique working end. For example, the tool element 40 includes a working end 60 in the form of a Phillips head type screwdriver. The tool element 42 includes a working end 62 in the form of a wedge. The tool element 46 includes a working end in the form of a wrench 64, for example, an Allen wrench. The tool element 48 includes a working end 66 in the form of an awl. Note that each of the tool elements 40, 42, 46, 48, though having unique features, is approximately the same length or extends the same distance from the pivot axis defined by the bolt 24.

A single tool element 70; namely, a pry element or pry tool element 70 is positioned at the second end 22. The pry element 70 includes a loop section 72 which fits around the shaft of the bolt 28 so that the pry tool element 70 may pivot about an axis of bolt 28 between a storage position between the walls 14 and 16 of the body member 10 and an extended position wherein the tool element 70 may be utilized. The tool element 70 is made from a length of flat stock which has been machined and shaped in a desired fashion so as to form a unique type of pry bar mechanism. Specifically, the tool element 70 is machined or formed so that it has a distal wedge configuration or wedge section 74. The wedge section 74 terminates in a pair of bifurcated projections 76 and 78 spaced one from another to define a slot 80. The wedge section 74 and, more particularly, the projections 76 and 78 may thus be inserted under the head of a fastener, for example, a push type plastic fastener of a body panel of a vehicle. The slot 80 will fit around a shaft of the fastener and will thus enable positioning of the wedge member projections 76 and 78 fully under the head of the fastener to provide a mechanical advantage so that the fastener may be appropriately pried and removed.

The pry bar tool element 70 is an elongate member which also folds into the region for storage between the side walls 14 and 16. Thus, all of the tool elements 40, 42, 46, 48 and 70 may be folded compactly between the side walls 14 and 16 when the fastener removal tool is not in use. Each of the tool elements 40, 42, 46, 48, 70 may, however, be pivoted to a working position as needed.

Figure 4:
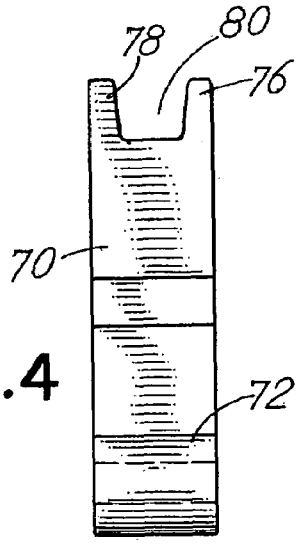
FIG. 4 is a plan view of the pry member tool element of the invention.
Figure 5:
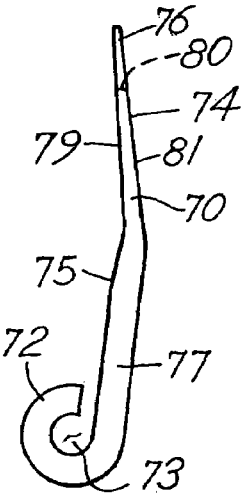
FIG. 5 is a side view of the pry member tool element of FIG. 4.
Figure 2:
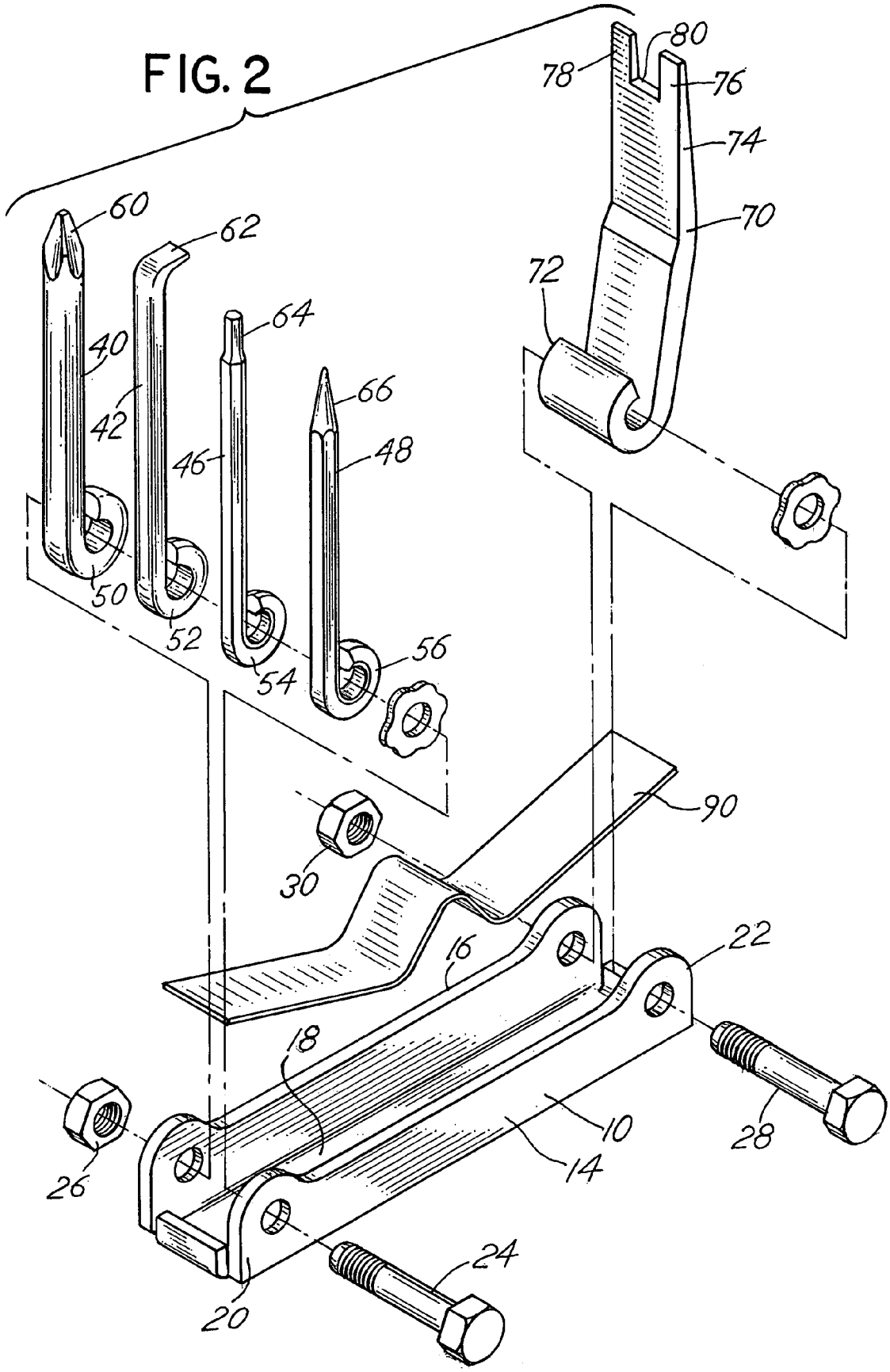
FIG. 2 is an exploded isometric view of the tool of the invention illustrating the component parts thereof.

FIGS. 4 and 5 illustrate the tool element or pry 70 in greater detail and depict numerous features of pry 70. Thus, the pry 70 includes loop 72 formed by bending flat plate stock in a clockwise sense as viewed in FIG. 5. The loop 72 defines a through passage 73 which receives the shaft of bolt 28. The loop 72 thus extends or is positioned so that passage 73 is generally fully above the plane 75 of a first flat planar plate section 77 of tool 70. The tool 70 is retained on bolt 28 through passage 73 so that the loop 72 is in direct opposed relation to the spring member 90 and web 18 as shown in FIG. 1. Tool 70 further includes second pry end section or wedge section 74 having a top surface 79 forming an obtuse angle in the range of about 160° to 175° with the plane 75 of first section 77. A preferred angle is about 1730. As a consequence, element 70 conveniently fits over tool elements 40, 42, 46, 48 in the tool folded condition as depicted in FIG. 1. This arrangement facilitates a number of functions: The elements 40, 42, 46, 48 are retained by tool or element 70. This is a protective and safety feature since the potentially sharp ends of elements 40, 42, 46, 48 are shielded. Also, the angular relationship of the sections 74, 77 of element 70 facilitates placement of section 74 under a headed fastener for a prying action when the tool is held against the palm or inside finger pads of a user. To further facilitate placement under the head of a fastener, wedge section 74 is defined by converging flat planar surfaces 79, 81.

An important feature of the invention is the use of a spring member 90 which is positioned within the trough or region between the walls 14 and 16. The spring member 90 frictionally engages with the end loop portions or sections of the various tool elements (e.g. loop 72) mounted on the respective pins or shafts of the bolts 24 and 28. In this manner, all of the tool elements are frictionally engaged by the spring member 90 so that upon positioning of any one tool element in a desired orientation, causes that tool element to tend to remain in that position to facilitate utilization by the mechanic or workman.

The spring member 90 comprises a thin sheet of spring steel which is shaped or formed so that it will fit between the walls 14 and 16 and extend the length of the body member 10 for frictional engagement of the ends thereof against the respective tool elements 40, 42, 46, 48 and 70 which are mounted on a bolt 24. Thus, a single spring member 90 is utilized inasmuch as the engagement thereof with the tool elements at the first end 20 and second end 22 simultaneously serves to maintain the spring element 90 properly shaped and positioned between the walls 14 and 16 and in engagement with the various tool elements. Note spring 90 is longer than the length of the trough between walls 14 and 16. Thus, it is deformed to the configuration in FIG. 1 and fits tightly against end loop of each tool element 40, 42, 46, 48, 70.

The bolt 24 may include a spring or wave washer to frictionally engage and maintain the tool elements and/or pry tool 70 snuggly between the sides of the walls 14, 16.

While there has been set forth a preferred embodiment of the invention, it is understood that the invention is to be limited only by the following claims and equivalents thereof.

What is claimed is:

1. An adjustable and multiple working element fastener removal tool comprising, in combination:

a body member in the form of an elongate trough with a first end and an opposite second end;

a plurality of at least three tool elements, each having a pivot end and a working end and each of substantially equal length, said three elements mounted adjacent the first end of the trough by a pivot pin member, each of said three tool elements being independently pivotal about the pivot pin to thereby expose the working end, each working end being uniquely configured, said tool elements each being pivotal between a storage position in the trough and a working position extending from the trough;

a single bifurcated pry tool element pivotally mounted at the second end of the trough, said pry tool element including a pivotal end and a working end, said pivotal end of the pry tool element pivotally retained on the body member by a second pivot pin, said working end of the pry tool element including a wedge shaped section having a bifurcated open end, said pry tool element pivotal between a first position in the trough body member fitting over the three tool elements and a working position, said pry tool element further comprising a first planar section of flat stock with a bottom surface side and a formed loop on the bottom surface side forming said pivot end, said first planar section joined to said wedge shaped section, said wedge shaped section forming a downwardly depending section from the first planar section bottom surface at an angle of about 160° to 175° with respect to the first section; and a biasing member mounted in the body member for engaging the pivot ends of the tool elements for frictionally maintaining the tool elements in a generally fixed pivot position.

2. The tool of claim 1 wherein the trough includes generally parallel side walls spaced apart to receive the at least three elements at the first end and the pry tool element at the second end.

3. The tool of claim 1 wherein the working end of the at least three tool elements has an end configuration consisting of a form selected from the group consisting of an awl, a wedge, a polygonal wrench and a screwdriver.

4. The tool of claim 2 wherein the tool elements are all pivotal to a storage position between the first and second ends in the trough of the body member.

* * * * *